United States Patent [19]

Tucker et al.

[11] Patent Number: 4,939,383

[45] Date of Patent: Jul. 3, 1990

[54] WALLBOX-MOUNTABLE DIMMER AND SWITCH

[75] Inventors: Darryl W. Tucker, Royersford; Russell J. Jacobs, Center Valley; Joel S. Spira, Coopersburg, all of Pa.

[73] Assignee: Lutron Electronics Co., Inc., Coopersburg, Pa.

[21] Appl. No.: 257,499

[22] Filed: Oct. 14, 1988

[51] Int. Cl.[5] ..... H01C 10/38

[52] U.S. Cl. ..... 307/139; 200/335; 307/125; 338/176; 338/200

[58] Field of Search ..... 307/112, 115, 125, 130, 307/131, 1, 135, 139, 140, 141, 141.4; 200/320, 335; 338/176, 179, 198, 199, 200

[56] References Cited

U.S. PATENT DOCUMENTS

| | | | |
|---|---|---|---|
| 2,740,873 | 3/1956 | Kronk | 200/295 |
| 4,563,592 | 1/1986 | Yuhasz et al. | 307/115 |
| 4,695,820 | 9/1987 | D'Aleo et al. | 338/199 |

OTHER PUBLICATIONS

Lutron Electronics Co.-Nova® Brochure, P/N 362-023, T30, 6/88.

Lightolier Controls-Product Selection Guide, p. 4-Neptune Preset.

Power Controls DUO De-Hummer TM 3-Speed Fan Control/2-Level Light Dimmer, P/N 1-43-027-1.

Panasonic Variable Resistors, No. 1, 1987/1988 Catalog, pp. 1-69.

*Primary Examiner*—A. D. Pellinen

*Assistant Examiner*—Jeffrey A. Gaffin

[57] ABSTRACT

A dimmer and switch device is adapted for mounting on a wall. The elements of the device that are visible when it is mounted on a wall are easily replaced. In another embodiment, a linear slide dimmer and push-button switch device are arranged in juxtaposition, so that a section of the dimmer slider can pass through the switch mechanism. A high-power, push-button switching device combines a high-power switch and a latching device. A dimmer includes a potentiometer that is marked by detents to permit stable, reproducible dimmer settings. The switching device and dimmer are suitable for use in the dimmer/switch.

10 Claims, 3 Drawing Sheets

FIG. 3
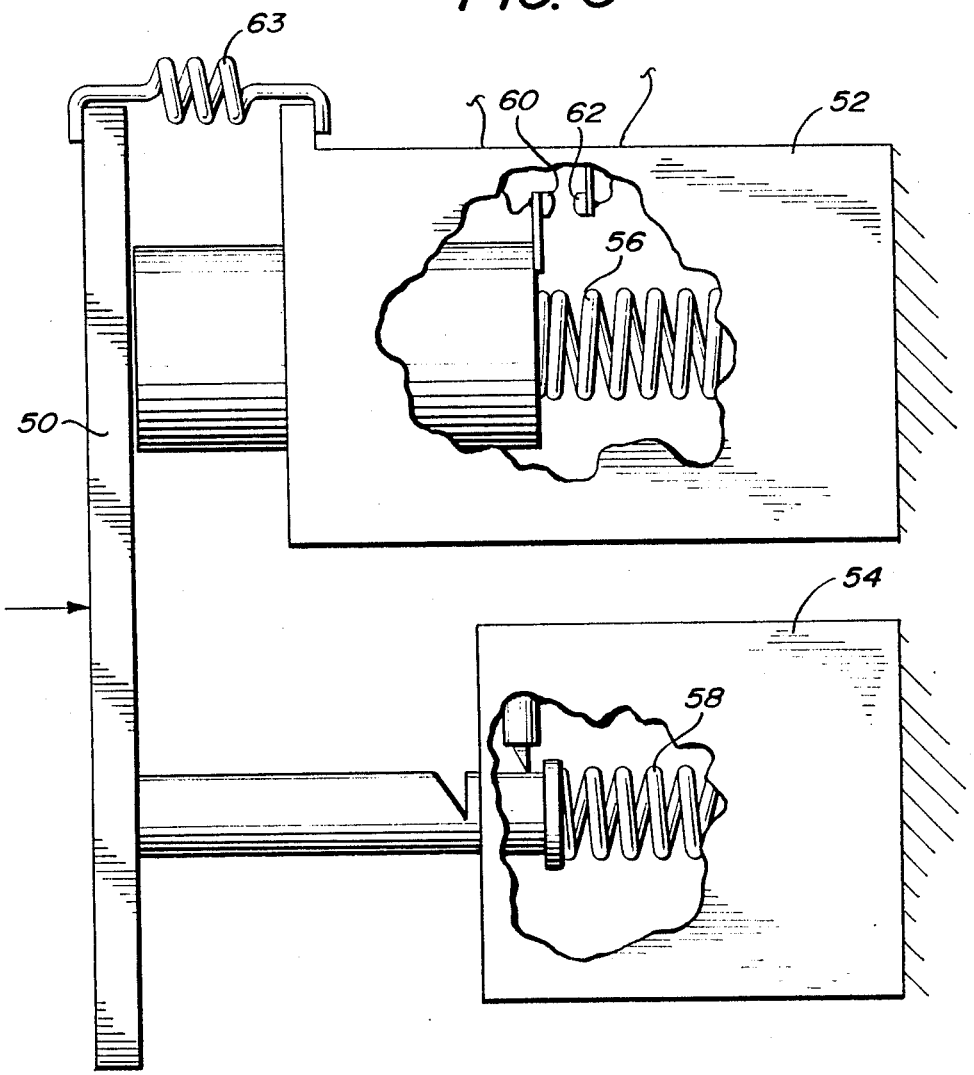
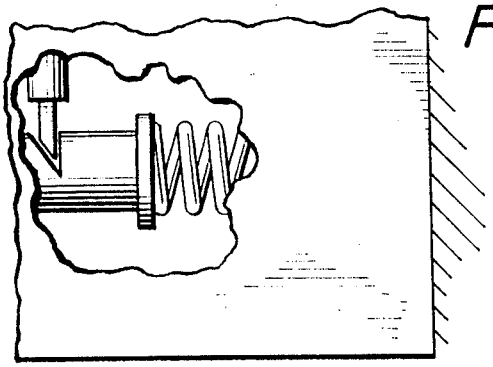
FIG. 3a

FIG. 4
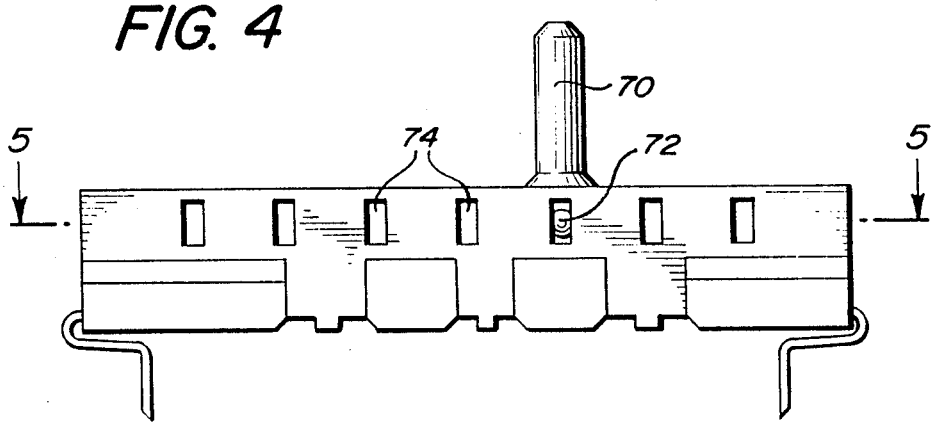
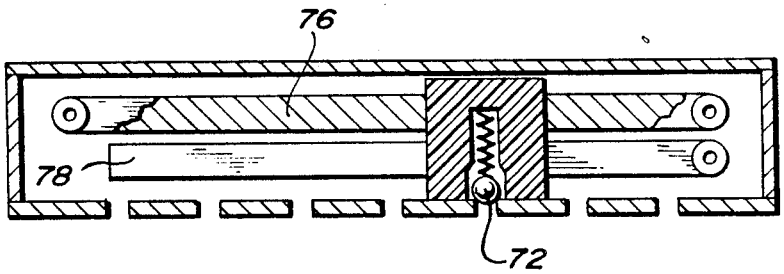
FIG. 5

WALLBOX-MOUNTABLE DIMMER AND SWITCH

BACKGROUND OF THE INVENTION

1. Field of the Invention

This invention relates to a dimmer and switch and, more particularly, to a wall-mountable dimmer and switch that have readily-replaceable actuator and face plate elements.

2. Description of the Related Art

Wall-mountable electrical controls are well known and in widespread use. In many cases, the control is a simple toggle switch that mounts in a wallbox and controls the on/off state of a light, or other electrically-powered device, or both. In other cases, the control in the wallbox is a dimmer, which can continuously vary power to a load, such as a lighting load or a motor.

A variety of face plate assemblies have been designed to cover the wallbox and wiring, while still permitting access to the electrical control. A plate with a rectangular slot is a simple configuration often used with a toggle switch. More complex configurations have been designed to serve various functional or aesthetic considerations.

An assembly for use with a push-button switch was disclosed in U.S. Pat No. 2,740,873, issued Apr., 3, 1956, to K. P. Cronk. That assembly comprises a backing plate, which supports an electrical switch, and a face plate, which covers and attached to the backing plate. The backing and face plates have openings to accommodate a button that operates the switch. The face plate is held in place on the backing plate by pins that are invisible for the exterior. A touch switch assembly that likewise has an invisible face plate moounting means was disclosed in U.S. Pat. No. 4,563,592, issued Jan. 7, 1986 to S.J. Yuhasz et al.

A push-button light switch sold under the "Jung'-'name, includes flexible snaps to connect with mating members on a cover plate/push button.

An assembly designed for use with a linear slide dimmer is disclosed in U.S. Pat. No. 4,835,343, issued May 30, 1989 to Graef et al., incorporated herein by reference. That application discloses a face plate designed for use with a "decorator" stype wallbox-mounted electrical control, which has an integral support plate with a shallow insulating escutcheon protruding from its front surface (i.e., the surface away from the wallbox).

Another linear slide dimmer assembly is the NOVA®/ dimmer, sold by Lutron Electronics Co. That assembly includes a metal yoke that mounts to a wallbox, a slide that moves between rails on the yoke, and a face plate that has, on its back surface (facing the wallbox), snaps that mate with the rails. A multi-location Nova® dimmer (Model No. N-600ML) includes an electronic touch-switch whose actuator comprises part of the face plate.

A face plate assembly that has a three-part structure and that permits a face plate to be of a simple construction and to be mounted withou tools is disclosed in U.S. Pat No. 4,924,349, for a Face Plate Assembly for Electrical Devices, incorporated herein by reference.

A combination linear slide dimmer and switch (Neptune Preset) is sold by Lightolier Corp., Secaucus, NJ. The actuator slide knob moves up and down within an opening in the face plate, while maintaining contact with a stationary backing plate that is recessed behind the face plate. The knob connections to the dimmer pass around the edges of the backing plate. A push-button switch is mounted at the bottom of the face plate opening.

SUMMARY OF THE INVENTION

In accordance with the present invention, a wallbox-mountable assembly comprises, in combination, (a) a wiring device;

(b) a generally flat support plate for said device, removably attachable to said wallbox;

(c) a generally flat intermediate plate, having a first surface that is attached to a surface of said support plate and, opposite said first surface, a second surface that faces outward when said plates are mounted in a wallbox, said second surface being interrupted by a peripheral, outward-facing first cantilever snap;

(d) a covering member having a peripheral, inward-facing first connector for demountable engagement with said first cantilever snap on said intermediate plate; and (e) a frame for mounting around the perimeter of said covering member.

In another embodiment of this invention, a wallbox-mountable device for controlling power to an electrical load comprises, in combination, (a) a push-button actuated switch to alternately turn power to said load on and off, (b) a dimmer, including a manualy-operable actuator, for adjusting power to said load, (c) means for transmitting to said switch a force exerted on said push button, and (d) an opening in said force transmitter to permit a section of said manually-operable actuator to pass through it.

A high-power switching device of the present invention comprises, in combination, (a) a high-power, push-button switch, comprising a movable electrical contact and a stationary electrical contact, (b) a low-force, push-button two-position latching device, comprising a movable member and a stationary member, and (c) means for joining said movable contact of said high-power switch and said movable member of said latching device, whereby one position of said latching device maintains an electrical connection between said contacts.

In yet another embodiment of the present invention, a wallbox-mountable dimmer comprises a manually-operable actuator for controlling intensity to a load, in which said actuator motion is marked with detents.

The wallbox-mountable dimmer comprises a manually-operable actuator for controlling intensity to a load, in which said actuator motion is marked with detents.

The wallbox-mountable assembly of the present invention permits easy removal and replacement of actuator and face plate elements in order to accommondate changing taste or wall decors. The dimmer and push-button switch of this invention include a dimmer, having a full-range slide actuator, whose bottom section can pass through the element that transmits the push-button force to the switch.

BRIEF DESCRIPTION OF THE DRAWINGS

FIG. 3 is a schematic, in partial cutaway, of a switching device of the present invention.

FIG. 3*b* is an exploded view of the latching device.

FIG. 4 depicts a potentiometer that is an element of a dimmer of the present invention.

FIG. 5 is a cross sectional view of the potentiometer of FIG. 4.

DETAILED DESCRIPTION OF THE INVENTION

The present invention provides a wallbox-mountable dimmer and push-button switch, in which the dimmer actuator can move through an opening in the mechanism that transmits force exerted on the push button to the switch.

Figure 1:
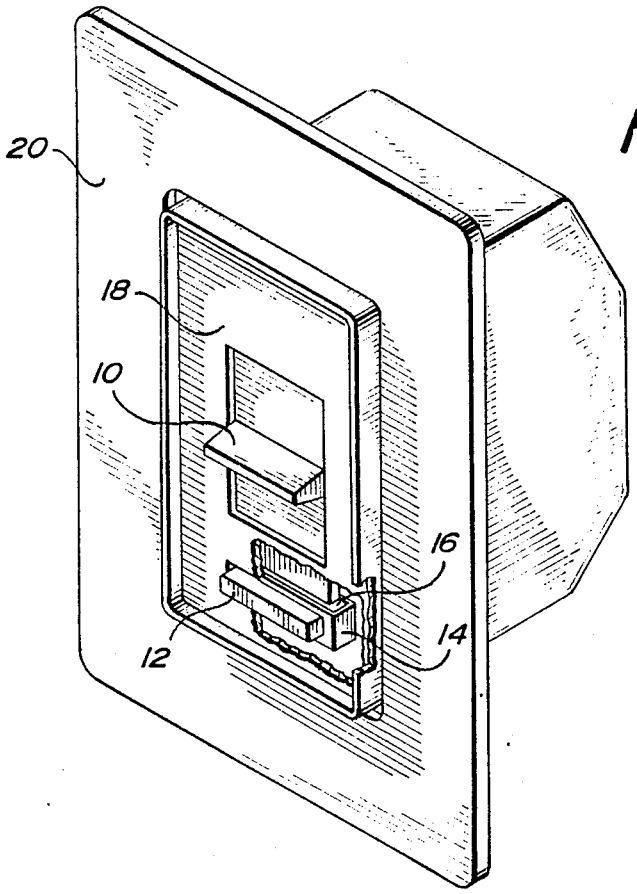
FIG. 1 is a schematic, in partial cutaway, of switch and dimmer of the present invention.

FIG. 1 depicts a preferred embodiment of a dimmer and switch, in which dimmer actuator 10 moves linearly. The switch is preferably a mechanical power switch, by which is meant a switch that directly controls power to a load. The switch alternately turns power off, or turns power on to a level determined by the position of actuator 10. The switch is actuated by depressing push button 12 and transmitting the force to the switch mechanism by way of force transmitter 14. For aesthetic reasons, it is desirable that the push button be symmetrical about the vertical center line of actuator 10. opening 16 in force transmitter 14 accommondates actuator 10, permitting it to have a full range of travel. The lower section of actuator 10 is preferably flexible, so that push button 12 can be actuated even when that section is in opening 16 of force transmitter 14.

Power to the load (not shown) is a minimum when actuator 10 is at the bottom of its travel and increases as the actuator is moved up. Preferably, as the actuator is moved up, there are detents at intervals to mark stable, reproducible power settings. The detents can be provided by using a slide potentiometer, of a sort available from Alps Electric Co., in a circuit of a type known in the art (see e.g., U.S. Pat. No. 3,746,923 ., issued J212 et al.). Preferably, push button 12, cover plate 18, and frame 20 are adapted for snap-attachment. Many snap-attachment methods known in the art are suitable. For example, flexible extensions on push button 12 can snap into corresponding holes on force transmitter 14. A mechanism for snap-attachment of cover plate 18 is discussed later in this specification. A mechanism for snap-attachment of frame 20 is disclosed in U.S. Pat. No. 4,835,343, issued May 30, 1989, to Graef et al. Typically, the elements visible when the device is mounted on a wall are actuator 10, push button 12, coverplate 18, and frame 20. Actuator 10 is contained by cover plate 18, and each of the other lements is preferably adapted for snap-on attachment. If the visible elements are colored, they can each be selected to match or contrast with the other elements and the color of the wall on which the device is mounted. These elements can easily be replaced, whenever desired; for example, when the wall coloring is changed.

Figure 2:
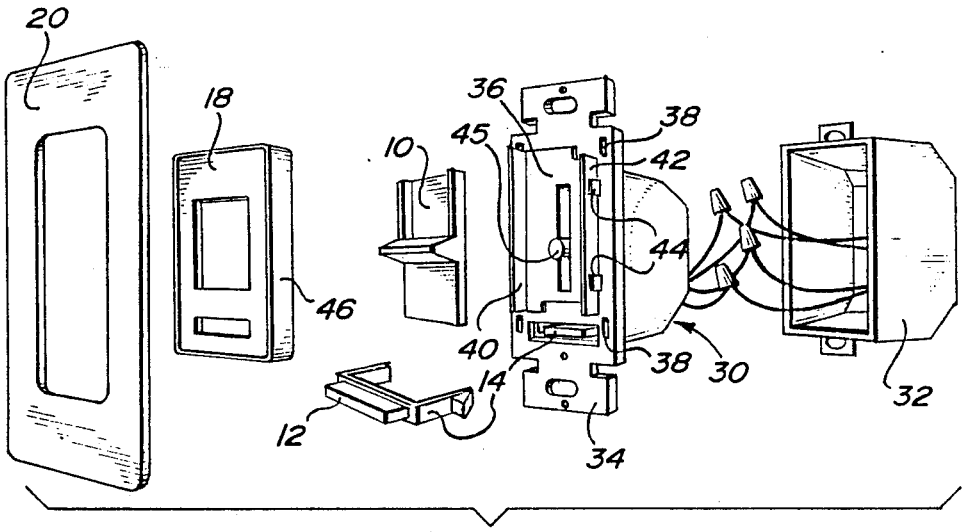
FIG. 2 is an exploded schematic of a face plate assembly of the present invention.

FIG. 2 is an exploded view of an assembly of the present invention. A wiring device — in this case, a dimmer and switch contained in back box 30 — mounts into a standard wallbox 32. The device is supported on support plate 34. As shown in FIG. 2, cover plate 18 snaps onto intermediate plate 36 and frame 20 has snaps (not shown) that fit into slots 38. Alternatively, frame 20 may snap into (redesigned) plate 36 or into another member that could screw onto support plate 34. In a preferred embodiment, intermediate plate 36 has a generally rectangular shape, with side walls 40 and 42 to constrain the motion of slider 10. Cantilever snaps 44 on the surface of plate 36 may be on the outside of the side walls and cover plate 18 may have a generally rectangular perimeter slightly larger than plate 36, with connectors (not shown) on the inside of inward-extending flange 46. The connectors on flange 46 are positioned to snap onto snaps 44 on intermediate plate 36. A slot in support plate 34 and intermediate plate 36 accommodates slide potentiometer shaft 45, which connects to actuator 10 to permit adjustment of the dimmer circuit in back box 30 to vary power to a load (not shown). Push button 12 is preferably adapted for snap mounting into force transmitter 14 and actuates the switch in back box 30.

FIG. 3 depicts a switching device of the present invention, suitable for use as the switch in the wallbox devices depicted in FIGS. 1 and 2. Bridge 50 joins, and simultaneously actuates, switch 52 (which may be of a type exemplified by Omron V-15G-185-K) and latching device 54. Switch 52 is high-power switch, by which is meant a switch that is rated for at least 15 A and that is resistant to damage from tungsten surge. Preferably, it is a snap action switch. FIG. 3 is cut away to show part of the interior of switch 52 and latching device 54 when the switch is in the "open" position. Pushing bridge 50 in the direction of the arrow compresses springs 56 and 58, ultimately causing latching device 54 to latch in the position shown at FIG. 3*b*. When latching device 54 is in that position, contacts 60 and 62 of switch 52 are held in contact. If bridge 50 is pushed again in the direction of the arrow, the latching device is released by a mechanism well known in the art (not shown), and springs 56 and 58 return the switching device to its original (open) position, with contacts 60 and 62 apart. In order to reduce the force required to actuate the switching device, bridge 50 is preferably biased in the direction shown by the arrow. One means of achieving a bias is by using spring 63. By using spring 62 or a similar device, switch 52 may be actuated by a force of 500 g, or less. Preferably bridge 50 needs to travel no more than about 5 mm to open (or to close) switch 52. Preferably, the position of bridge 50 is different for latched and unlatched positions, so that the bridge position indicates the switch status. Latching device 54 may also be a switch (for example, Alps SP PHI-1). Thus, it may open and close a circuit in unison with (or opposition to) switch 52. In a preferred embodiment as a switch, device 54 may, through a circuit well known in the art (not shown), indicate the status of the circuit controlled by switch 52. The status could involve a quantitative indication of a circuit parameter or could, alternatively, signal whether that circuit is on or off.

FIG. 4 depicts a slide potentiometer of a sort suitable for use in the present invention to provide a dimmer whose actuator motion is marked with detents. The dimmer may be of the type that is disclosed in U.S. Pat No. 3,746,923, issued Jul. 17, 1973, to Spira et al., incorporated herein by reference. The slide potentiometer that is an element of the dimmer of the present invention has a shaft 70 that provide stable, reproducible detents for the position of the slide. FIG. 5 depicts the potentiometer in cross section, including resistive track 76 and conductive tract 78 along which the wiper (not shown) moves. A slide potentiometer of the type depicted in FIGS. 4 and 5 is available from Alps Electric Co. Alternatively, a rotary potentiometer with detents permits with detents.

The present invention having been described in connection with preferred embodiments, many variations and modifications will now become apparent to those skilled in the art. Therefore, the present invention is to be limited not by the specific disclosure, but only by the appended claims.

We claim:

1. A wallbox-mountable device for controlling power to an electrical load, comprising, in combination, (a) a switch actuated by a push button, to alternately turn power to said load on and off (b) a dimmer, including a manually-operable actuator, for adjusting power to said load (c) means for transmitting to said switch a force exerted on said push button, and (d) an opening in said force transmitter to permit a section of said manually-operable actuator to pass through it.

2. The device of claim 1 in which said switch is a mechanical power switch.

3. The device of claim 1 in which said actuator adjusts power by moving linerearly and is substantially symmetrical about a centerline in its direction of motion.

4. The device of claim 3 in which said switch push button is substantially symmetrical about said actuator centerline.

5. The device of claim 3 in which said actuator is constrained to move between a pair of substantially parallel rails.

6. The device of claim 3 in which said actuator section is flexible.

7. The device of claim 3 in which said actuator motion is marked by a plurality of detents.

8. The device of claim 1 further comprising means for supporting said device in a wallbox and a face plate for covering said support means.

9. The device of claim 8 in which said push button, said actuator, and said face plate comprise individually replaceable elements.

10. The device of claim 8 in which said face plate is actuator, and said face plate comprise individually replaceable elements.

* * * * *